United States Patent [19]

Jacobs et al.

[11] 4,148,249

[45] Apr. 10, 1979

[54] AXIALLY BALANCED, ADJUSTABLE VOLUME ROTARY MACHINE AND DRIVE SYSTEM UTILIZING SAME

[76] Inventors: Stephan J. Jacobs, 234 Canyon Rd., Salt Lake City, Utah 84103; Alfonse Stuertzel, 3665 S. 300 West, Salt Lake City, Utah 84115

[21] Appl. No.: 758,943

[22] Filed: Jan. 13, 1977

[51] Int. Cl.[2] ..... F01B 13/06

[52] U.S. Cl. ..... 91/485; 91/488; 91/497

[58] Field of Search ..... 91/485–487, 91/491, 497

[56] References Cited

U.S. PATENT DOCUMENTS

| | | | |
|---|---|---|---|
| 2,827,859 | 3/1958 | Crane | 91/485 |
| 2,972,961 | 2/1961 | Clark | 91/485 |
| 3,066,613 | 12/1962 | Reinke | 91/485 |
| 3,086,477 | 4/1963 | Ruhl | 91/487 |
| 3,155,047 | 11/1964 | Keel | 91/485 |
| 3,225,701 | 12/1965 | Griffith | 91/488 |
| 3,626,810 | 12/1971 | Morey | 91/497 |
| 3,955,477 | 5/1976 | Rutz | 91/497 |

*Primary Examiner*—William L. Freeh
*Attorney, Agent, or Firm*—B. Deon Criddle

[57] ABSTRACT

A rotary machine usable as a pump, compressor, turbine or motor, for example. Rotating piston cylinders have radially movable pistons therein and the cylinders are mounted within a control ring and a housing. The control ring is tangentially pivoted within the housing to vary the volume flow through the machine and the torque application transmitted by a shaft, as well as the direction of flow through the machine. Pressure fluid operated balancing pistons are used to counter the axial thrust placed on the rotor by liquids applied to the rotor, regardless of the direction of flow through the machine.

9 Claims, 3 Drawing Figures

AXIALLY BALANCED, ADJUSTABLE VOLUME ROTARY MACHINE AND DRIVE SYSTEM UTILIZING SAME

BRIEF DESCRIPTION OF THE INVENTION

1. Field of the Invention

This invention relates to rotary piston pumps and motors and the like.

2. Prior Art

Rotary pumps and motors have long been known. These machines have generally included a stator and a rotor and have used either movable vanes or pistons to compress or to be driven by liquid passed through the machines.

U.S. Pat. No. 1,156,816, for example shows a rotary machine usable as either a pump or a motor. In the disclosed machine vanes are carried by a rotor and serve to compress or to be driven by liquid moving through the machine. Machines of this type, with vanes, have been used in the past, but have not, to my knowledge, proven satisfactory for use where high pressures, i.e. of at least 4500 p.s.i. are involved.

U.S. Pat. No. 2,164,888, discloses a rotary machine that utilizes reciprocating pistons. U.S. Pat. No. 2,164,888 discloses a variable delivery pump wherein the reciprocating pistons operate within a pivoted control ring. Liquid is supplied to and exhausted from the piston cylinders through a central axial passage system. The control ring position is controlled by a screw and an opposing spring biased sleeve member. A control knob on the screw is marked with a graduation so that a central position of the control ring in the machine housing can be determined. Turning of the knob and screw will then move the control ring in one direction beyond the centered position. The direction of flow through the pump is determined by which side of the center of the shaft the ring has been displaced. The degree of displacement of the control ring in either direction past the centered position will control the volumetric flow through the pump.

SUMMARY OF THE INVENTION

Principal objects of the present invention are to provide a rotary machine usable as either a pump or a motor and that is reversible in operation to change from a pumping function to a motor function and vice versa.

Other objects are to provide a rotary machine that can provide for variable flow control in either a pump or motor mode and wherein the volumetric flow can be readily regulated.

Still other objects are to provide a rotary machine that can be inexpensively constructed, easily assembled and that will include a balanced rotor in either a pump or a motor mode, to thereby minimize wear and to increase the life expectancy of the machine, while maintaining a central input or output shaft axially fixed.

Principal features of the invention include a rotor mounted to have movement axially along an output shaft while being rotatable with the shaft; flow ports through a machine housing adapted to sequentially align with rotor ports interconnecting the piston chambers with one rotor face; a thrust plate carried by an opposite rotor face; pressure responsive balance pistons pressing against the thrust plate at sides opposite to the flow ports; and means for applying the pressures developed at the flow ports to oppositely acting ones of the balance piston.

Additional objects and features of the invention will become apparent from the following detailed description and claims, taken together with the accompanying drawing showing a preferred form of the invention.

THE DRAWING

In the drawing:

FIG. 1 is a front elevation view of the rotary machine of the invention, with the front housing, rotor and thrust plate each partially broken away to show the interior components thereof;

FIG. 2, a vertical section view, taken on the irregular line 2—2 of FIG. 1; and

FIG. 3, a schematic view of a vehicle drive system utilizing the rotary machine of the invention.

DETAILED DESCRIPTION

Figure 2:
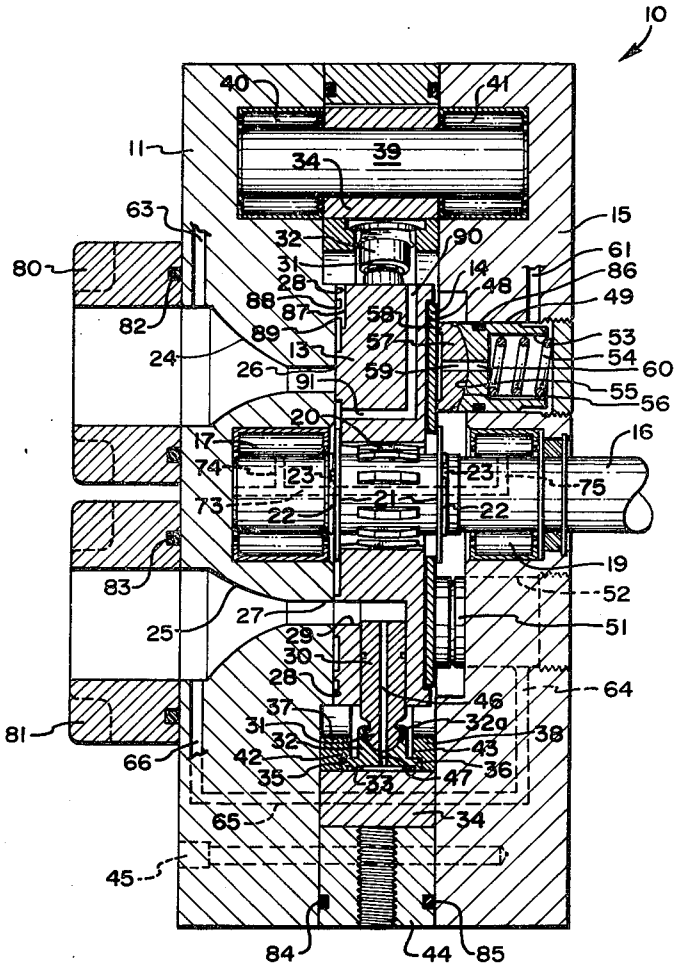
Figure 1:
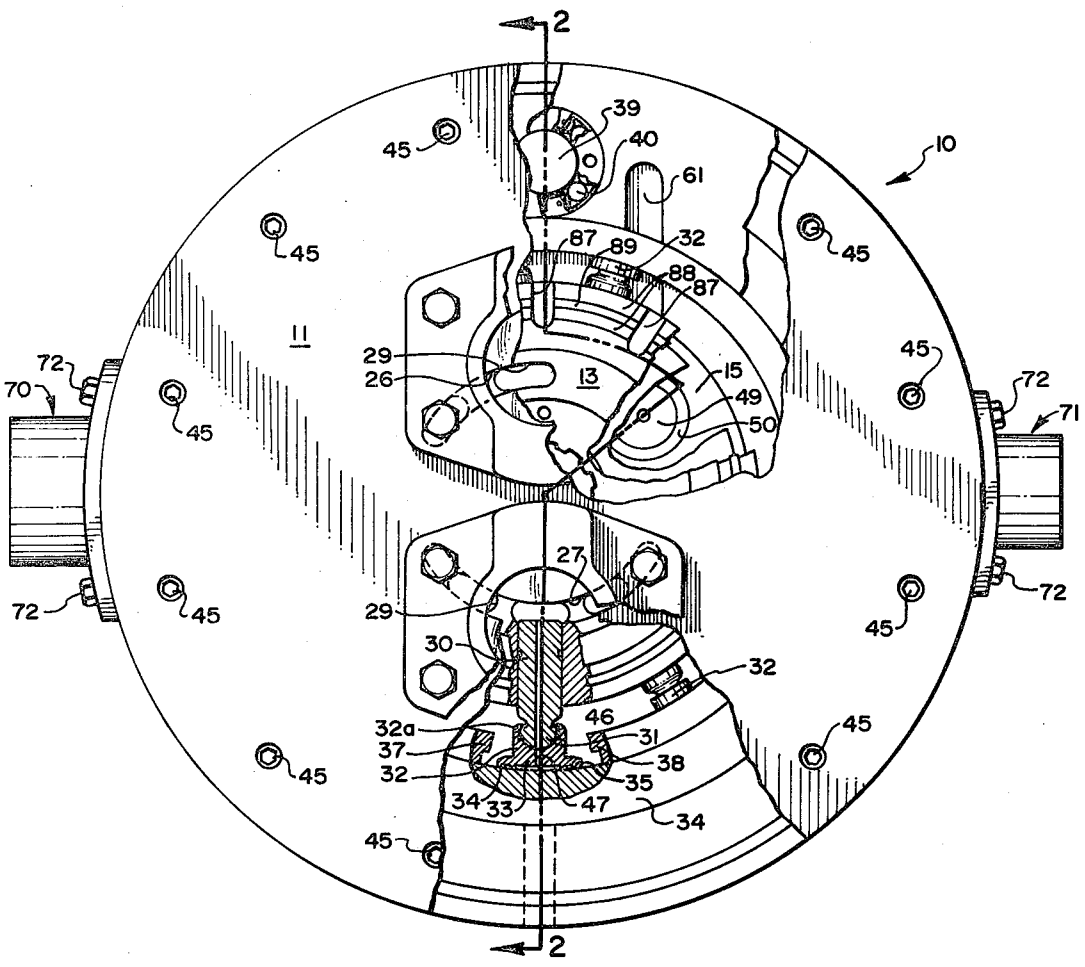

Referring now to the drawing:

In the illustrated preferred embodiment, the rotary machine of the invention is shown generally at 10. As shown, the machine includes a front housing plate 11, a rotor 13, a thrust plate 14, and a rear housing plate 15.

A central shaft 16 has one end journaled by a bearing 17 positioned in a recess 18 provided therefor in the front housing plate 11 and is journaled by a bearing 19 through the rear housing plate 15. The rotor 13 is spline connected at 20 to the shaft 16 and is slightly movable axially along the shaft while being rotatable therewith. Washers 21 encircle the shaft at opposite sides of the rotor 13 to limit the axial movement of the rotor on the shaft and split rings 22, snapped into grooves 23 in the shaft, hold the washers 21 in place.

A pair of flow ports 24 and 25 are spaced at opposite sides of the centerline through the shaft and extend through the front housing plate to terminate in curved slots 26 and 27, respectively, formed on the inside face of the front housing plate.

The rotor 13 has a plurality of radial cylinders 28 formed around the periphery thereof and extending thereinto. A port 29 through one face of the rotor intersects each cylinder 28. The ports 29 are elongate and are curved to form arcuate slots. In a preferred embodiment eleven cylinders 28 and ports 29 are provided, but it should be apparent that more or fewer such cylinders and ports can be provided and since they are identically constructed only two such structures are here illustrated.

A piston 30 reciprocates in each cylinder 28 and each piston has a ball 31 formed on an end projecting outwardly of the cylinder. A shoe 32 is mounted to each ball 31 by a socket **32*a* of the shoe. Each shoe includes, in addition to the socket 32*a*, a follower 33 that is arcuately curved to correspond to the inner curve of a control ring 34, and has outwardly extended flanges 35 and 36 that are adapted to be engaged by shoe rings 37 and 38**, respectively.

The control ring 34 forms a ring around the rotor 13 and the pistons 30 and shoes 31 carried thereby and is tangentially mounted by a pivot pintle 39 that extends through a control ring, and that has its ends journaled in bearings 40 and 41, respectively mounted in openings provided in the front and rear housing plates 11 and 15.

Shoe rings 37 and 38 are loosely fitted inside the control ring and respectively include flanges 42 and 43 that extend beyond the flanges 35 and 36 to slidably hold the followers 33 between the control ring 34 and the flanges 42 and 43.

The control ring is positioned within a larger central housing ring 44 and the bolts 45 inserted through the front housing plate 11 and the central housing ring 44 are threaded into the rear housing plate 15 to clamp the front housing plate, central housing ring and rear housing plate together. So arranged, the control ring is able to swing from one side to the other within the central housing ring, as will be hereinafter further described.

A port 46 through each piston 30 communicates with a port 47 through the shoe such that pressure in the piston cylinder is communicated through the ports to the face of the follower 53 and between the follower and the control ring 34.

The thrust plate 14 encircles the shaft 16 and fits flat within a recess 48 provided therefor in the rotor 13. The thrust plate is adapted to be acted on by thrust plate engagement means, in opposition to the pressure of liquid moving into and out of the cylinders.

The thrust plate engagement means includes a pair of pistons 49 (only one of which is shown in FIG. 2) positioned in spaced apart bore holes 50 (only one of which is shown) provided therefor in the rear housing plate. The bore holes 50 are located so that force applied through the pistons therein will be opposite to force applied at the port 24 and are opposite the ends of the curved slot 26. Similarly another pair of pistons 51 (only one of which is shown in FIG. 2) are positioned in spaced apart bore holes 52 (only one of which is shown in dotted lines) provided therefore in the rear housing plate. The ports 52 are located so that force applied through the pistons therein will be opposite to force applied at the port 25 and are opposite the ends of the curved slot 27.

Each of the pistons 49 and 51 is recessed at 53 to receive one end of a spring 54, th other end of which abuts the end of the bore hole in which the piston is positioned. At the end opposite spring 54, each piston is made concave at 55 to receive a convex projection 56 formed on a thrust shoe 57. The ball and socket arrangement thus formed between the piston and the shoe allows a flange 58 on a face of the shoe to be flush against the thrust plate during all positions and movement of the thrust plate with the rotor 13.

A passage 59 through each shoe 54 is aligned with a passage 60 through the piston and communicates the face of each shoe, inside the flange 58 with the recess 53 in which the spring 54 is located at the rear of each piston.

Ports 61 in the rear housing plate communicate the bore holes 50 behind pistons 49, through ports in the central housing ring and ports 63 in the front housing plate with the flow ports 24. Similarly, ports 64 in the rear housing plate communicate the bore holes 52 behind the pistons 51 with ports 65 through the central housing ring, ports 66 in the front housing plate and the flow port 25.

Actuators 70 and 71 are mounted by bolts 72 to the central housing ring 44 and provide a means whereby the control ring 34 is pivoted around the pintle 39.

The actuators may be of the mechanical type shown in U.S. Pat. No. 2,164,888 for example, or preferably are fluid operated, such as is hereinafter described. In either case, the actuators are mounted to be opposite one another at opposite sides of the central housing ring and ninety degrees around the central housing from the pivot pintle 39. The actuators are adapted to engage the rotor and to pivot it from side to side within the central housing ring 44.

Shaft 16 has an axial bore hole 73 extending partially therethrough and transversely extending intercept ports 74 and 75. So arranged, oil flowing through the thrust plate engagement pistons and thrust shoes can lubricate the bearing 19, and then flow through port 75, bore hole 73 and port 74 to lubricate bearing 17.

In operation, the position of the control ring 34, as set by the actuators 70 and 71, regulates the unit and the volume of flow through the unit and the direction of rotation of the rotor. Thus, if the inlet port 25 is connected to a reservior of oil for example, upon rotation of the shaft 16 the pistons will be moved in or out of the cylinders 28 in accordance with the position of the control ring 34 since each shoe is held close to the inner surface of the control ring centrifugally while being guided by the shoe rings 37 and 38.

As the shaft 16 and rotor are turned it will be apparent that fluid will be drawn into those piston cylinders connected to the inlet port 25 by the curved slot 27 and the ports 28 of the cylinders aligned with inlet 27 and wherein the pistons are moving out of the rotor. The entering fluid is then compressed as the rotor turns and the pistons are moved into the rotor, with the compressed fluid being discharged under pressure from the cylinders as the ports 28 thereof come into alignment with the curved slot 26 at the end of flow port 24. The control ring may be positioned, as necessary to allow either port 24 or 25 to serve as an inlet port and the other said port an outlet port and to allow for the reversal of rotation of the shaft 16.

When the unit is used as a motor to drive the shaft 16, fluid, under pressure enters the cylinders connected to the inlet port 24 or 25 acts against the pistons 30 and rotor 13 and rotates the rotor such that the pistons will be moved out with respect to the rotor. The fluid is then discharged from the cylinders as the ports 29 come into alignment with the curved slot formed on the inside of the front housing and connected to the other port 24 or 25, serving as the outlet port.

Nipples 80 and 81, fixed to the housing 11, provide means for respectively connecting fluid lines to the ports 24 and 25. O-rings 82, seated in grooves 83, provided therefor in the nipples seal the nipples to housing 11. Other O-rings 84 and 85 fit in grooves provided therefore in the faces of the central housing ring to prevent loss of fluid between the end plates and the central housing ring. Still other O-rings 86 fit in grooves around each piston 47 and 51 of the thrust plate engagement means. The O-rings 86 allow the pistons to move, as required, but prevent leakage of fluid between the pistons and the walls of the bore holes provided therefor in the rear housing plate.

During rotation of the rotor oil in the piston cylinders is centrifugally forced through the ports 46 and 47 to provide a lubricating film for the shoes 32 as they move within the control rings 34. Radial slots 87 allow the oil to move from the inside of the control ring past lands 88 formed on the face of the rotor and into ring shaped lubrication grooves 89 on the rotor face but outwardly of the slots 26 and 27. At the same time ports 90 and 91, spaced around the rotor allow oil to move into a lubricating groove 92 inside the grooves 26 and 27. This greatly reduces the friction between the rotor and the front housing plate.

As has been previously noted, the pressure present at the flow ports and acting to force the rotor against the rear housing plate is also applied to the thrust plate engagement means to balance the applied forces at the flow ports. The springs 54 lightly bias the pistons 49 and 51 and socketed shoes 57 into engagement with the thrust plate 14 and hold the thrust plate in engagement with the rotor 13.

If a high pressure is present at flow port 24, the same high pressure will be communicated through the ports 63, aligned ports through the central housing ring and ports 61 in the rear housing plate to the rear of pistons 49 and the rotor 13, between the flow port 25 and the pistons 49 is held in an axially balanced position. If, at the same time, a low pressure is present at the flow port 24 the same low pressure will be communicated throgh ports 66, 65 and 64 to the rear of pistons 51 to hold the rotor 13 between flow port 25 and the pistons 51 in an axially balanced condition. Naturally, if the high and low pressures are reversed at the flow ports, the same balanced condition of the rotor is maintained.

The axially balanced adjustable volume rotary machine herein described has been found to be very satisfactory for use where high pressures of at least 4500 p.s.i. are required. Because of the axially balanced configuration and rotor lubrication arrangement, little wear occurs to the pump and it has been found that exceptionally long life can be achieved for the machine.

The machine has been found to be ideally suitable for use in the driving of automotive vehicles and particularly to electro-hydraulic vehicles.

Figure 3:
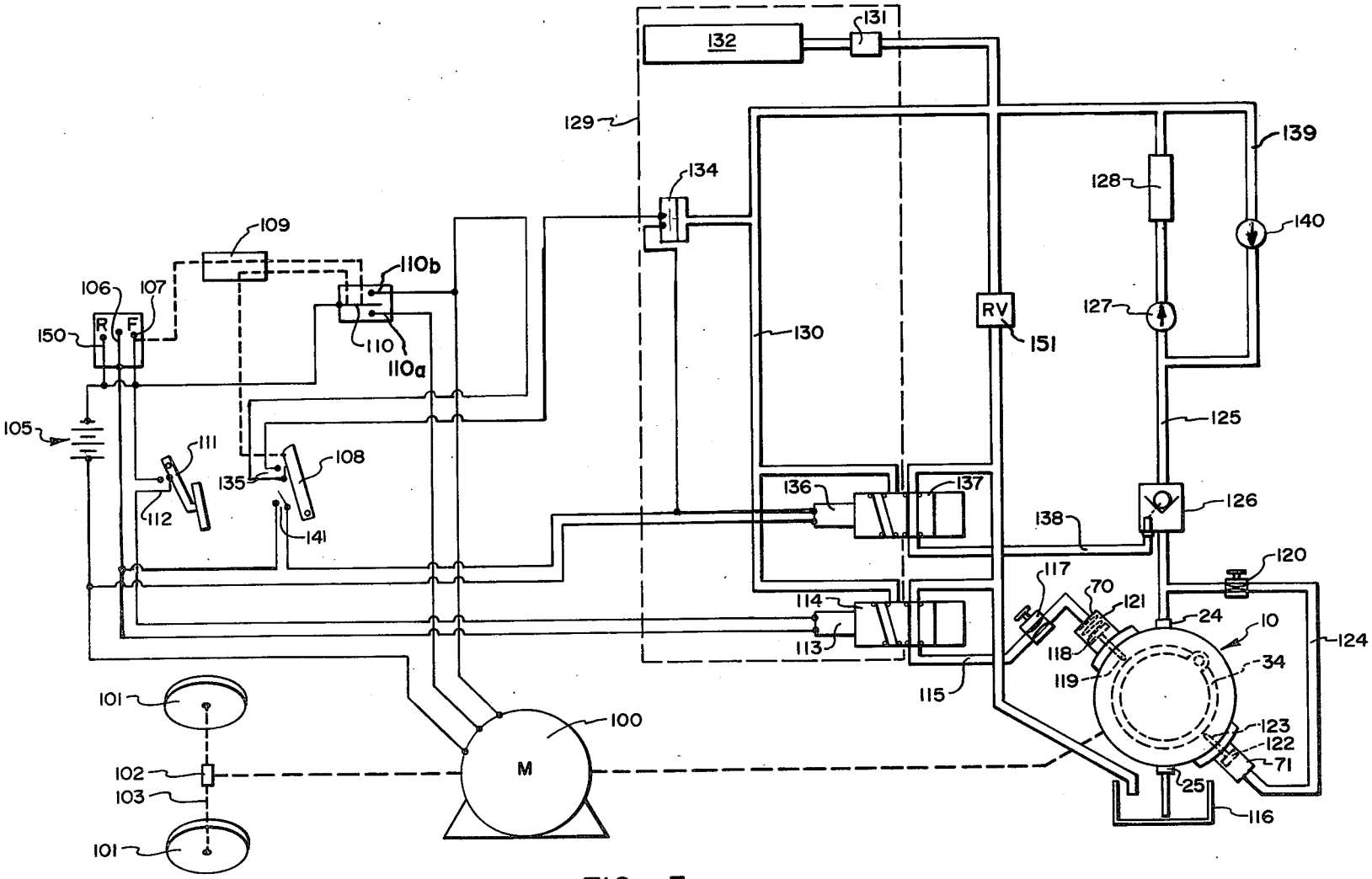

As shown in FIG. 3, the machine 10 is well suited for use in systems having a prime mover and requiring a supplemental acceleration boost. As shown, the machine 10 is arranged in series with an electric motor 100 to power the drive wheels 101 of the vehicle, not shown, through a differential unit 102 and axles 103, but it will be apparent that the same system could be used to drive other loads, as well.

In the system as schematically illustrated, the initial energy for accelerating the load comes from the batteries 105. To initiate such acceleration, the switch 106 is moved to a forward drive position, completing a circuit through contact 107 and placing the system in a forward operation mode.

The accelerator pedal 108 is depressed, and upon the first movement of the pedal operates through a controller 109 to move a contactor switch 110 such that a circuit is completed through a contact 110*a* to the reversible electric drive motor 100 to drive it in a forward direction and to thereby accelerate and drive the load, i.e., the wheels 101.

When it is desired to stop or brake the vehicle the brake pedal 111 is depressed. The initial movement of the brake pedal closes switch 112 and continued movement of the brake pedal will operate the usual vehicle brakes, not shown, in conventional fashion.

Closing of switch 112 completes the circuit to a solenoid 113 that controls operation of a two-position, three-way, normally open valve 114. In its "normally open" position, i.e., when solenoid 113 is deenergized, fluid from a fluid operated actuator 70 of the machine 10 is exhausted through a line 115 and the valve 114 to a reservoir 116. As will be further explained, when the solenoid 113 is energized, the valve is operated to allow high pressure fluid therethrough, and through the line 115 and a variable restrictor 117 in the line 115 to the actuator 70.

In the system shown, both the actuators 70 and 71 are fluid operated. Actuator 70 comprises a fluid cylinder having a piston 118 therein and a piston rod 119 projecting therefrom through the central housing ring of machine 10 to engage the control ring 34 of the machine 10. Fluid is supplied to and exhausted from the back of the piston 118 by the line 115 and a spring 121 within the actuator housing normally biases the piston to move the piston rod against control ring 34.

Actuator 71 comprises a fluid cylinder with a piston 122 therein having a cross-sectional area somewhat smaller than that of piston 118 and a piston rod 123 projecting therefrom through the central housing ring of the machine 10 and into engagement with the control ring 34. Fluid is supplied to and exhausted from the actuator 70, behind the piston 121 through a line 124 having a variable restrictor 125 therein.

When valve 114 is operated to exhaust fluid from actuator 70, the valve, at the same time, cuts off flow of fluid, under pressure to the actuator.

The spring 121 moves the piston 118 to extend the piston rod 119 and to force the control ring 34 over center in the direction of the actuator 71. The rotation of the shaft 16 of the machine 10, caused by the turning of wheels 101, then causes the machine to begin pumping oil from reservoir 116 through flow port 25 and out the flow port 24, under pressure, as has been heretofore described. The discharging oil, under pressure is communicated through the variable restrictor 120 and line 124 to the back of piston 122. The high pressure, acting on the piston 122 expels the piston rod 123 and moves the control ring 34 back towards its centered position, thereby decreasing the pumping action of the machine 10 until only a minimum pressure output results. The minimum pressure output is regulated by the balancing pressure required at the back of piston 122 to move the control ring to an essentially centered position and is transmitted through line 125, a pilot operted check valve 126, a check valve 127, a filter 128 and throughout the high pressure portion of the system, shown generally at 129. The minimum pressure is thus always present in the high pressure portion of the system and is available to operate the controller 70 when the brake pedal 111 is first actuated.

As previously noted, when the brake pedal 111 is first actuated it completes a circuit to energize the solenoid 113 and to permit the available high pressure in line 130 to be supplied through line 115 to the back of piston 118. The high pressure acting on the back of piston 118 and the spring 121 bias the piston 118 to expel the piston rod 119 and to move the control ring of machine 110 overcenter towards the actuator 71. The variable restrictor 117 controls the rate of pressure application to the back of piston 118 and therefore the rate at which piston rod 119 is expelled and the control ring is moved.

As the piston 118 is moved and the piston rod 119 is expelled it overcomes the biasing force of the same fluid acting on the smaller piston and the control ring is moved.

As the control ring moves off center towards actuator 71, the machine pumps fluid from the reservoir 116 through flow port 25, out flow port 24 and into line 125. The flow is then through the pilot operated check valve 126, check valve 127, filter 128, and into line 130. At the same time the flow is through an excess pressure responsive valve 131 and into an accumulator 132. During such braking, the action of the wheels in driving the machine 10 as a pump (through the axle 103 differential 102, and shaft 16) causes the fluid to be pumped from reservoir 116 into the accumulator, as previously described. The accumulator preferably utilizes a compressible gas as a spring and the fluid pumped therein will compress the gas as the pressure in the system is increased. As the pressure in the system increases the vehicle will decelerate due to the energy of the inertia of the vehicle being absorbed by the gas. As the vehicle comes to a stop the pumping action of the machine 10 will stop. At this time the pilot operated check valve 126 prevents reverse flow from the accumulator chamber through the machine 10.

If the braking cycle just described has continued for a sufficiently long time to allow a predetermined pressure to have built up in the accumulator 132 and in line 130, for example 2500 p.s.i., the pressure will close a pressure switch 134.

Thereafter, if the accelerator pedal is again depressed, the initial movement will act through controller 109 to close the contactor switch 110 with contact 110*a*. At the same time a switch 135 is operated by the accelerator pedal to furnish power from the power supply through the closed pressure switch 134 to activate a solenoid 136 of a valve 137.

When solenoid 136 is energized it operates valve 137 to allow high pressure fluid from line 130 to pass therethrough and into a line 138 leading to the pilot operated check valve 126. The high pressure from line 138 unseats the check valve of valve 136 to allow from the accumulator 132, through excess flow valve 131 by pass line 139 and the check valve 140 therein around the filter 128 and check valve 127, the pilot operated check valve 126, line 125, port 24, machine 10 and port 25 to the reservoir 116. At the same time, the time, the high pressure is transmitted through orifice 125 and line 120 to the back piston 122 of actuator 71. Also at this time, the valve 114 is operated to place the actuator 70 in connection with the reservoir 116. Consequently, the smaller piston 122 is moved and the piston rod 123 is expelled to overcome the force of spring 121 and to move the control ring 34 over center towards the actuator 70. The machine 10 then acts as a motor to cooperate with the motor 100 in driving the wheels 101.

The operation of the machine 10 as a motor continues until the pressure in the accumulator and high pressure system falls to a level at which the pressure switch 134 will open. This pressure is below that at which the switch closes and, for example, may be 2100 p.s.i. When the pressure switch opens solenoid 136 is deenergized and valve 137 is returned to its "normal" condition where pressure in line 138 is relieved through the valve to the reservoir 116. When the pressure in line 138 is relieved, the check valve of the pilot operated check valve 126 is again seated and flow from accumulator 132 to the machine 10 is stopped.

When the flow through the valve 126 to the machine 10 is stopped, the pressure at the back of the small piston 122 is reduced and the spring 121 acts on piston 118 to move the control ring back to its centered position.

If further booster power is needed and it is desired to continue operation of the machine 10 as a motor, to supplement the operation of motor 100 it is only necessary to push the accelerator until another switch 141 is closed. This switch is connected directly to the solenoid 136 and by-passes the pressure switch 134. When the switch 141 is closed the solenoid 136 is energized and valve 137 is operated, as previously described, to allow high pressure fluid into line 138, thereby moving the check valve 136 off its seat. All pressure in the accumulator 132 can thus be used to drive machine 10 as a motor, if desired. The pressure, will, of course, build-up in the accumulator chamber again during subsequent braking operations.

The system herein described is especially suited for use with vehicles and particularly with electrically powered vehicles. However, it will be apparent that other prime movers could as well be used with but minor modification of the overall system. The system described provides for actuation of the machine 10 as a pump to store energy during braking, and as a motor to assist in propulsion during acceleration. Thereafter the prime mover can be used to maintain vehicle speed and accumulated energy can be provided to meet extraordinary demands such as may occur during passing, hill climbing or emergency conditions.

When reverse motion of the vehicle is desired the switch 106 is moved to contact 150 and the controller 109 is operated to move switch 110 to complete a circuit through contact 110*b* for reverse operation of the motor. It is not contemplated in the present system that the machine 10 be used to assist in such reverse movement.

While other controllers 109 may be satisfactory, an SCR controller, manufactured by the General Electric Company has been found suitable for selectively actuating the collector switch 110 in response to positioning of the switch 106 and movement of accelerator 108.

The hydraulic system is protected from over pressurization by a pressure relief valve 151 that is connected to line 130 and that will open in the event of excess pressure in the system to discharge into the reservoir 116.

In the event of a line rupture or overspeeding of the vehicle wheels or drive shaft the excess flow valve 131 will close. The excess valve can be reset by pressurizing of the high pressure portion of the system as has been previously described.

Although a preferred form of our invention has been herein disclosed, it is to be understood that the present disclosure is made by way of example and that variations are possible without departing from the scope of the hereinafter claimed subject matter, which subject matter we regard as our invention.

We claim:

1. An axially balanced rotary machine comprising housing means having a central cavity and front and rear housing plates;

a control means having a central cavity and front and rear housing plates;

a control ring in the cavity;

means eccentrically mounting the control ring to swing in the cavity;

a rotor rotatable within the control ring; piston cylinders extending radially into the periphery of the rotor and spaced therearound;

a port extending transversely to each piston cylinder and extending from a face of the rotor into the cylinder, said ports being equidistant from the center of the rotor face;

piston means slidably positioned in each piston cylinder, said piston means being in centrifugal engagement with the control ring during rotation of the rotor;

a shaft journaled in the front and rear housing plates, connected for rotation with the rotor such that the rotor is movable axially with respect to said shaft and projecting through one of said plates;

a pair of diametrically spaced flow ports through the front housing, each said flow port terminating in an arcuate slot and said arcuate slots being in alignment with the ports through the face of the rotor;

pressure compensating means opposite each flow port whereby the pressure applied from each flow port is applied to opposite faces of the rotor, each said pressure compensating means comprising at least one bore hole in the housing, piston means including a balancing piston slidable in said bore hole and a balancing shoe mounted by a ball and socket connection on a front end of the piston, passage means through the housing interconnecting each flow port with each bore hole opposite said flow port at a location behind said piston means, and a thrust plate between the rotor and each piston, said thrust plate fitting flat against a rotor surface and loosely around the shaft and being engaged by said balancing shoe; and spring means biasing said piston means against said thrust plate and said thrust plate against said rotor surface.

2. An axially balanced rotary machine as in claim 1, wherein the balancing shoe has a recess in a face thereof engaging the thrust plate and aligned passages are provided through the piston and the shoe to communicate the rear of the piston with the recess in the face of the balancing shoe.

3. An axially balanced rotary machine comprising housing means having a central cavity and front and rear housing plates;

a control ring in the cavity;

means eccentrically mounting the control ring to swing in the cavity;

a rotor rotatable within the control ring, one face of said rotor being in engagement with the front housing and having a plurality of concentric ring shaped grooves formed therein and spaced radial slots interconnecting said grooves and the outer periphery of said rotor, the face of the rotor in engagement with the front housing plate having a ring shaped slot at the inner periphery thereof, said rotor having spaced lubrication passages therethrough from the outer periphery of the rotor to the ring shaped slot at the inner periphery of the rotor;

piston cylinders extending radially into the periphery of the rotor and spaced therearound;

a port extending transversely to each piston cylinder and extending from a face of the rotor into the cylinder, said ports being equidistant from the center of the rotor face;

piston means slidably positioned in each piston cylinder, said piston means being in centrifugal engagement with the control ring during rotation of the rotor and comprising a piston in the cylinder and projecting outwardly thereof, said piston having a central passage therethrough, a shoe articulatorily connected to the piston, said shoe being centrifugally placed in contact with said control ring during rotation of the rotor and said shoe having a recessed portion on an outer face thereof and a central passage therethrough in alignment with the passage through the piston, whereby the piston cylinder is connected through the passages in the piston and the shoe with the recessed portion of the shoe;

guide rings within the control ring and helping to hold the shoes connected to pistons in the cylinders in centrifugal contact with the control ring.

a shaft journaled in the front and rear housing plates, connected for rotation with the rotor such that the rotor is movable axially with respect to said shaft and projecting through one of said plates said shaft and the journal means therefor being surrounded by the ring shaped slot at the inner periphery of the face of the rotor;

a pair of diametrically spaced flow ports through the front housing, each said flow port terminating in an arcuate slot and said arcuate slots being in alignment with the ports through the face of the rotor; and pressure compensating means opposite each flow port whereby the pressure applied from each flow port is applied to opposite faces of the rotor.

4. An axially balanced rotary machine as in claim 3, wherein the pressure compensating means opposite each flow port comprises at least one bore hole in the housing;

piston means adapted to fit into said bore hole;

spring means biasing said piston means against said rotor; and passage means through the housing interconnecting each flow with each bore hole opposite said flow port at a location behind said piston means.

5. An axially balanced rotary machine as in claim 4, wherein the pressure compensating means opposite each flow port comprises a pair of spaced apart bore holes in the rear housing plate opposite the ends of the arcuate slot of the flow port;

piston means adapted to fit into each bore hole;

spring means biasing each said piston means against said rotor; and passage means through the housing interconnecting each flow port with each bore hole opposite said flow port at a location behind said piston means in said bore hole.

6. An axially balanced rotary machine as in claim 4, further including a thrust plate between the rotor and each piston means.

7. An axially balanced rotary machine as in claim 6, wherein the thrust plate fits flat against a rotor surface and loosely around the shaft.

8. An axially balanced rotary machine as in claim 7, wherein each piston means of each pressure compensating means comprises a balancing piston slidable in the bore hole;

a balancing shoe mounted on a front end of the piston to engage the thrust plate.

9. An axially balanced rotary machine as in claim 8, wherein the balancing shoe has a recess in a face thereof engaging the thrust plate and aligned passages are provided through the piston and the shoe to communicate the rear of the piston with the recess in the face of the balancing shoe.

* * * * *